US005818311A

United States Patent [19]

Hino

[11] Patent Number: 5,818,311

[45] Date of Patent: Oct. 6, 1998

[54] DIELECTRIC FILTER INCLUDING TRIMMING ELECTRODES

[75] Inventor: Seigo Hino, Nagoya, Japan

[73] Assignee: NGK Spark Plug Co., Ltd., Aichi-ken, Japan

[21] Appl. No.: 277,277

[22] Filed: Jul. 21, 1994

[30] Foreign Application Priority Data

Jul. 23, 1993 [JP] Japan ..... 5-044686 U

[51] Int. Cl.[6] ..... H01P 1/205

[52] U.S. Cl. ..... 333/202; 333/207

[58] Field of Search ..... 333/202, 203, 333/206, 207, 222, 223, 235

[56] References Cited

U.S. PATENT DOCUMENTS

| | | | |
|---|---|---|---|
| 4,462,098 | 7/1984 | D'Avello et al. | 333/206 X |
| 4,673,902 | 6/1987 | Takeda et al. | 333/206 X |
| 4,675,632 | 6/1987 | Kawano | 333/206 X |
| 4,800,348 | 1/1989 | Rosar et al. | 333/202 |
| 5,198,788 | 3/1993 | Phillips et al. | 333/207 |
| 5,327,108 | 7/1994 | Hoang et al. | 333/206 X |

FOREIGN PATENT DOCUMENTS

| | | | |
|---|---|---|---|
| 52102 | 3/1985 | Japan | 333/223 |
| 0038601 | 2/1987 | Japan | 333/202 |
| 6164205 | 6/1994 | Japan | 333/202 DB |

*Primary Examiner*—Benny Lee
*Attorney, Agent, or Firm*—Larson & Taylor

[57] ABSTRACT

A dielectric filter comprising a rectangular parallelepipedic dielectric ceramic block provided with a pair of resonance holes vertically bored therethrough, a conductive layer formed on the entire surface of the ceramic block except the top side of the block, a pair of input and output terminals arranged on a lateral side of the ceramic block and, additionally, coupling capacitance regulating or trimming electrodes arranged on the top of the ceramic block, each of said trimming electrodes extending from one of said input and output terminals to the vicinity of the opening of the corresponding resonance hole on the top side so that the coupling capacitance of the gap separating the input/output terminal and the resonance hole can be regulated by appropriately trimming the trimming electrode.

2 Claims, 4 Drawing Sheets

DIELECTRIC FILTER INCLUDING TRIMMING ELECTRODES

BACKGROUND OF THE INVENTION

The present invention relates to a dielectric filter to be suitably used for a telecommunication apparatus such as a portable telephone set or a mobile telephone set and, more particularly, it relates to a dielectric filter capable of finely regulating its input coupling capacitance and output coupling capacitance.

Normally a capacitance coupling is realized among a pair of terminals for input and output purposes, a first resonance hole arranged close to the terminals and a last resonance hole remote from the terminals in conventional dielectric filters as typically disclosed in Japanese Patent Publication No. 3-40962.

FIG. 1 shows such a conventional dielectric filter comprising a dielectric block a which has an upper surface b where the ceramic material of the block is exposed and a front surface provided with an input and output terminals c. The dielectric block a is provided with a pair of resonance holes d which are extended between the upper surface b and the bottom surface thereof. On the upper surface b of the dielectric block a are provided a pair of recessed electrodes e extending from the respective input and output terminals c and a pair of jutted electrodes f extending from respective ends of the resonance holes d. The jutted portion of each jutted electrode f is extended into the recessed portion of the corresponding recessed electrode e so that gaps g are formed between the jutted electrodes and the respective recessed electrodes to produce a desired input and a desired output coupling capacitance.

A conventional dielectric filter having a configuration as described above is disadvantageous in that the jutted electrodes f and the recessed electrodes e have, by definition, a complicated profile having a number of lines such that the jutted portion of each of the electrodes f is received by the recessed potion of the corresponding electrode e. Therefore, it is practically impossible to regulate the capacitance of the filter once the jutted and recessed electrodes are formed and hence to achieve an optimum input and an optimum output coupling capacitance for the filter.

SUMMARY OF THE INVENTION

It is, therefore, an object of the present invention to provide a dielectric filter that is free from the above identified disadvantage.

According to the invention, there is provided a dielectric filter comprising a rectangular parallelepipedic dielectric ceramic block provided with at least a pair of resonance holes vertically bored therethrough, a conductive layer formed on the entire surface of the ceramic block except all or part of the top surface or the top and bottom surfaces of the block and a pair of input and output terminals arranged on a lateral side of the ceramic block, wherein trimming or capacitance regulating electrodes are provided on the top surface or on the top and bottom surfaces of the ceramic block, each extending from one of said input and output terminals to the vicinity of the opening of the corresponding resonance hole on the same side so that the input and output terminals and the resonance holes are capacitively coupled by way of the trimming electrodes.

Preferably, each of the trimming electrodes may comprise a single conductor member which is partly cut out or to which a compensating conductor is added for regulating the input and the output coupling capacitance of the filter.

Alternatively, each of the trimming electrodes may comprise a plurality of small conductor pieces which are electrically bridged by a conductor paint for obtaining a predetermined input and a predetermined output coupling capacitance.

With a dielectric filter according to the present invention as defined above, if the coupling capacitance between each of the input and output terminals and the corresponding resonance hole is greater than a predetermined level, it can be reduced by partly cutting out the trimming electrodes, whereas, if the coupling capacitance is smaller than a predetermined level, it can be increased by adding a piece of electric conductor to each of the trimming electrodes such that the coupling capacitance may be regulated at will.

Now, the invention will be described by referring to the accompanying drawings that illustrate preferred embodiments of the present invention.

DETAILED DESCRIPTION OF THE INVENTION

Figure 1:
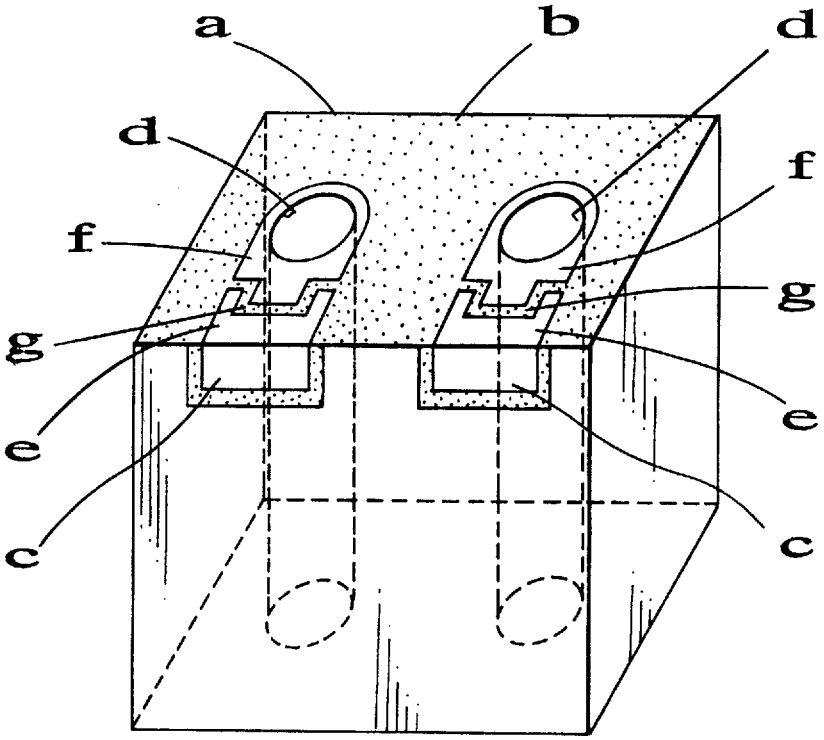
FIG. 1 PRIOR ART
FIG. 1 is a schematic perspective view of a conventional dielectric filter.
Figure 2:
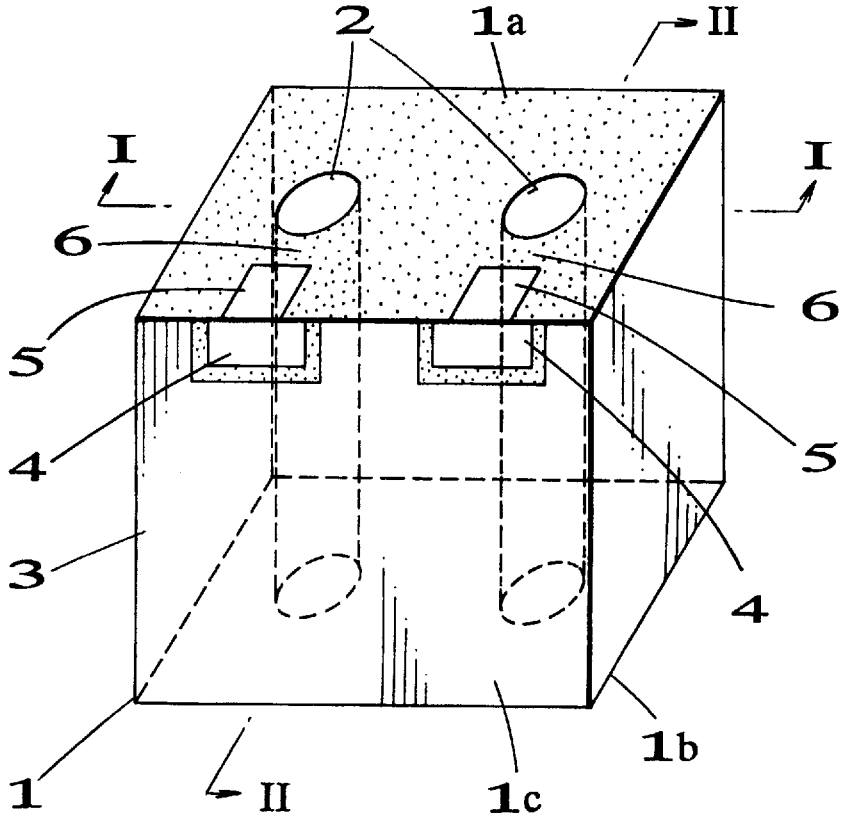
FIG. 2 is a schematic perspective view of a preferred embodiment of dielectric filter according to the present invention.
Figure 3:
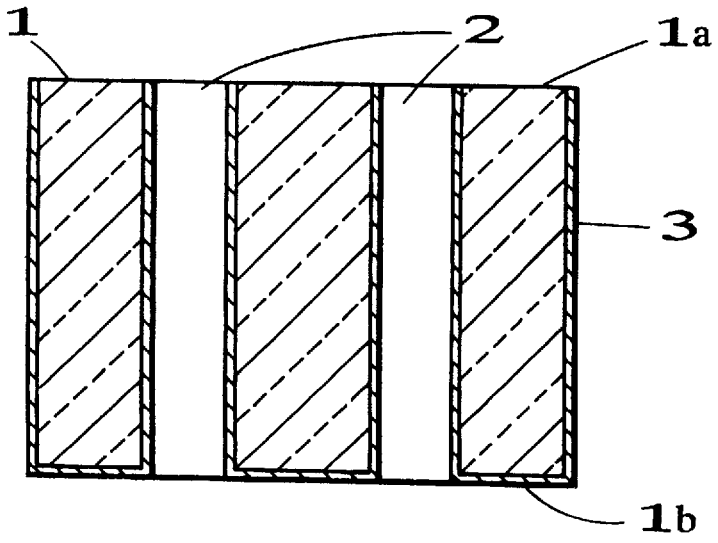
FIG. 3 is a sectional view of the embodiment of FIG. 1 taken along I—I line.
Figure 4:
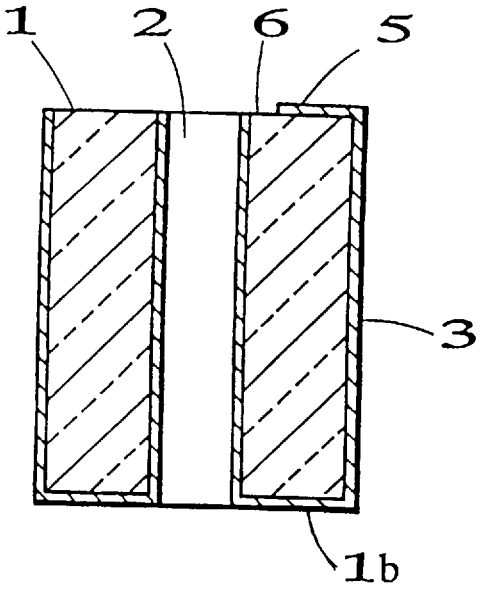
FIG. 4 is a sectional view of the embodiment of FIG. 1 taken along II—II line.

Referring firstly to FIGS. 2 through 5 that illustrate a first embodiment of the present invention, it comprises a rectangular parallelepipedic dielectric ceramic block 1 made of a dielectric ceramic composite having a high dielectric constant and a low loss rate such as BaO—$TiO_2$ or BaO—$TiO_2$-rare earth element, through which a pair of resonance holes 2 are vertically bored to produce openings at the top surface 1*a* and the bottom surface 1*b* (see FIGS. 2–4) of the ceramic block 1, a conductor layer 3 arranged on entire surface of the ceramic block 1 except the top surface 1*a* of the ceramic block 1, or on the four lateral side surfaces, the bottom surface 1*b* of the ceramic block 1 and the inner surfaces of the resonance holes 2, a pair of input and output terminals 4 arranged vis-a-vis the respective resonance holes 2 along the upper edge of a lateral side surface 1*c* (see FIGS. 2, 5) of the ceramic block 1, and a pair of trimming or capacitance regulating electrodes 5 (see FIGS. 2, 4 and 5) arranged on the top surface 1*a* of the ceramic block 1.

The conductor layer 3 may be formed by depositing metal material having a high conductivity such as silver or copper on the surfaces of the dielectric ceramic block 1 except the top surface 1*a* of the dielectric ceramic block 1.

Each of said trimming electrodes 5 has an end connected to the corresponding input or output terminal 4 and the other end extending to the vicinity of the corresponding resonance hole 2, so that the embodiment may have a desired input and a desired output coupling capacitance by securing appropriate gaps 6 (see FIGS. 2, 4 and 5) between the trimming electrodes 5 and the respective edges of the resonance holes 2.

While the input and the output coupling capacitance of a dielectric filter having a configuration as described above is a function of the size of the gaps 6 and the specific dielectric constant of the dielectric ceramic composite of the ceramic block 1, the dielectric filter, when manufactured, does not necessarily show a desired input and a desired output coupling capacitance because they are subject to errors that may take place during the manufacturing process.

Figure 5:
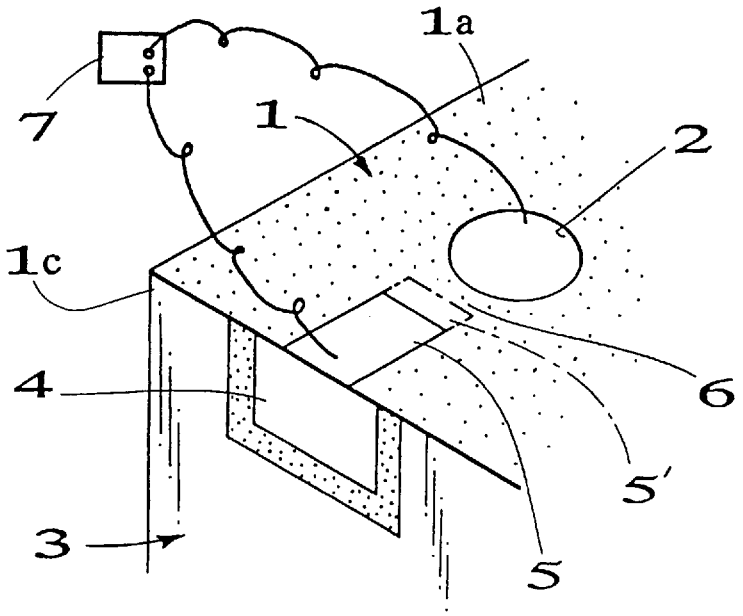
FIG. 5 is a partial perspective view of the embodiment of FIG. 1, showing one of the trimming electrodes partly eliminated at the front end thereof.

Referring to FIG. 5, the capacitance across each of the gaps 6 is measured for the embodiment by using a capacitance gauge 7 which is connected between the corresponding one of the input and output terminals 4 and that of the resonance holes 2. If the capacitance exceeds a predetermined level, an appropriate front end portion 5' of the corresponding trimming electrode 5 is cut out by using a laser, a cutting tool or some other appropriate means to enlarge the gap 6. If, on the other hand, the capacitance falls short of the predetermined level, a small piece of conductor (not shown) is added to the front end of the trimming electrode 5 to reduce the gap 6.

Figure 6:
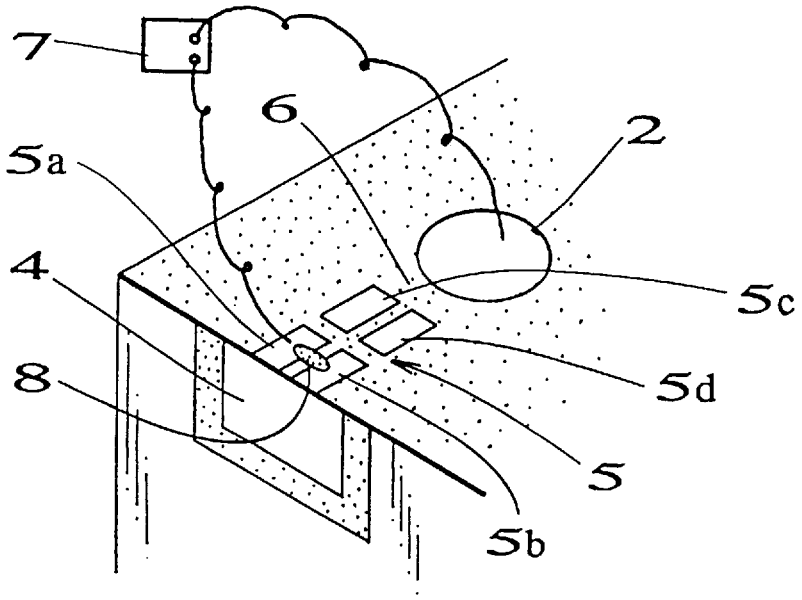
FIG. 6 is a partial perspective view showing an alternative trimming electrode.

FIG. 6 is a partial perspective view of an alternative trimming electrode that can be used for the embodiment of FIG. 1 and is actually composed of a plurality of small pieces 5*a*, 5*b*, 5*c*, and 5*d*. With this electrode again, the capacitance of the gap 6 separating the trimming electrode 5 and the corresponding resonance hole 2 is measured by means of the capacitance gauge 7 connected between the corresponding input or output terminal 4 and the resonance hole 2, and is regulated by applying a conductive paint 8 such as one made of pasty silver between, for instance, the pieces 5*a* and 5*b* to electrically connect them until a desired capacitance level is achieved.

An end of each of the resonance holes 2 is grounded by the conductor layer 3 (see FIGS. 3, 4) covering the bottom surface of the ceramic block 1 while the other end is electrically insulated by the exposed (dotted) top surface of the ceramic block 1 in the above embodiment.

Figure 7:
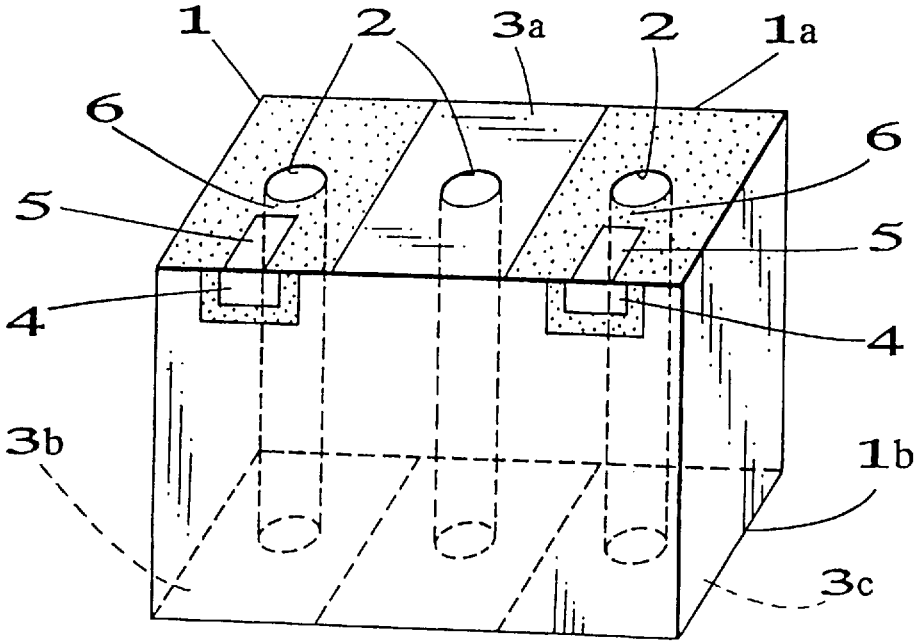
FIG. 7 is a schematic perspective view of another preferred embodiment of dielectric filter according to the present invention.

FIG. 7 illustrates another embodiment of the invention which is an interdigital type dielectric filter having three resonance holes 2, which are alternately grounded on the top surface 1*a* and the bottom surface 1*b* of the ceramic block 1 by way of respective conductor layers 3*a*, 3*b* and 3*c* connected to respective ends of the resonance holes, while the remaining ends of the resonance holes are electrically insulated by the respective exposed (dotted) areas of the top and the bottom surfaces of the ceramic block 1. With such a dielectric filter, again, a pair of trimming electrodes 5 are arranged so as to be connected to respective input and output terminals 4 and extended toward the respective outer resonance holes 2 and a desired coupling capacitance may be produced at each of the gaps 6 separating the input and output terminals 4 and the resonance holes 2 by appropriately trimming the trimming electrodes 5.

Thus, the concept of the present invention can be applied not only to dielectric filters having a pair of resonance holes, as in the case of the first embodiment, but also to those having three or more resonance holes as shown in FIG. 7.

At a first glance, each of the trimming electrodes may be connected at an end to the corresponding resonance hole and separated at the other end from an edge of the corresponding input or output terminal to produce a gap for coupling capacitance. However, with such an arrangement, the once established coupling capacitance may be varied when the dielectric filter is turned upside down on a printed circuit board and soldered to related circuits of the board as the gaps may be partly filled with solder. To the contrary, a dielectric filter according to the present invention and having a configuration as described above by way of embodiments is free from such a problem because the gaps are located close to the respective resonance holes and hence remote from the top surface of the printed circuit board if the filter is partly contaminated with solder.

As described above in detail, since a dielectric filter according to the present invention is provided with trimming electrodes arranged respectively between its input and output terminals and resonance holes to regulate the coupling capacitance, a desired input and a desired output coupling capacitance can be easily achieved for the filter. Thus, according to the present invention, high quality dielectric filters can be provided at low cost on an industrial basis.

I claim:

1. A dielectric filter comprising a rectangular parallelepipedic dielectric ceramic block provided with at least one pair of resonance holes, each resonance hole having a respective conductive coating layer thereon and extending vertically through said block, a conductive layer disposed on an outer surface of the ceramic block and electrically connected to the respective conductive coating layer of each of said resonance holes, and a pair of input and output terminals arranged on a lateral side surface of the ceramic block, and surrounded by a non-conductive portion of the ceramic block, respective rectangular trimming electrodes being provided on at least a top surface of the ceramic block, each of said trimming electrodes extending from a respective one of said input and output terminals to a region adjacent to the opening of a corresponding resonance hole, so as to define a respective gap between each of the trimming capacitors and the corresponding resonance hole and so as to provide respective capacitive coupling between each of the input and output terminals and the corresponding resonance hole, and each of said trimming electrodes comprising a single conductor member which is provided with a corresponding additional conductor added in response to capacitance requirements to reduce the respective gap with the corresponding resonance hole and to thereby regulate the input and output coupling capacitance of the filter, said top surface being otherwise free of conductive material in an area surrounding a respective resonance hole and extending between said lateral side surface and a opposite lateral side surface.

2. A dielectric filter comprising a rectangular parallelepipedic dielectric ceramic block provided with at least one pair of resonance holes, each resonance hole having a respective conductive coating layer thereon and extending vertically through said block, a conductive layer disposed on an outer surface of the ceramic block and electrically connected to the respective conductive coating layer of each of said resonance holes and a pair of input and output terminals arranged on a lateral side surface of the ceramic block, and surrounded by a non-conductive portion of the ceramic block, respective rectangular trimming electrodes being provided on at least a top surface of the ceramic block, each of said trimming electrodes extending from a respective one of said input and output terminals to a region adjacent to the opening of a corresponding resonance hole, so as to provide respective capacitive coupling between each of the input and output terminals and the corresponding resonance hole, and each of said trimming electrodes comprising a plurality of small conductor pieces which are electrically bridged by a conductive paint so as to obtain, respectively, a predetermined input coupling capacitance and a predetermined output coupling capacitance.

* * * * *